United States Patent [19]

Sawada et al.

[11] Patent Number: 4,628,021

[45] Date of Patent: Dec. 9, 1986

[54] HEAT DEVELOPABLE COLOR PHOTOGRAPHIC MATERIALS WITH SILVER HALIDE CONTAINING IODIDE

[75] Inventors: Satoru Sawada; Shingo Nishiyama, both of Kanagawa, Japan

[73] Assignee: Fuji Photo Film Co., Ltd., Kanagawa, Japan

[21] Appl. No.: 595,757

[22] Filed: Apr. 2, 1984

[30] Foreign Application Priority Data

Apr. 1, 1983 [JP] Japan ..... 58-56878

[51] Int. Cl.[4] ..... G03C 1/40; G03C 5/54; G03C 1/02

[52] U.S. Cl. ..... 430/203; 430/217; 430/543; 430/550; 430/559; 430/560; 430/567; 430/617; 430/619

[58] Field of Search ..... 430/203, 217, 543, 550, 430/559, 560, 567, 617, 619

[56] References Cited

U.S. PATENT DOCUMENTS

| | | | |
|---|---|---|---|
| 4,021,240 | 5/1977 | Cerquone et al. | 430/203 |
| 4,022,617 | 5/1977 | McGuckin | 430/203 |
| 4,396,712 | 8/1983 | Kinoshita et al. | 430/619 |
| 4,430,415 | 2/1984 | Aono et al. | 430/203 |
| 4,473,631 | 9/1984 | Hirai et al. | 430/203 |
| 4,474,867 | 10/1984 | Naito et al. | 430/203 |
| 4,483,914 | 11/1984 | Naito et al. | 430/203 |
| 4,500,626 | 2/1985 | Naito et al. | 430/203 |

FOREIGN PATENT DOCUMENTS

| | | | |
|---|---|---|---|
| 0076492 | 4/1983 | European Pat. Off. | 430/203 |

*Primary Examiner*—Richard L. Schilling

*Attorney, Agent, or Firm*—Sughrue, Mion, Zinn, Macpeak, and Seas

[57] ABSTRACT

A heat developable color photographic material is disclosed. The color photographic material is comprised of a support having thereon a light-sensitive mixed crystal silver haloiodide having a silver iodide content of 4 to 40 mole %, a binder and a dye-providing substance capable of providing a mobile dye, when the silver haloiodide is reduced to silver by heating, in chemical relation to the reaction. The color photographic material is capable of producing an image by quick development in a substantially water free state. Even when the color photographic material is used in combination with an organic silver salt it is capable of providing excellent color sensitivity.

29 Claims, No Drawings

HEAT DEVELOPABLE COLOR PHOTOGRAPHIC MATERIALS WITH SILVER HALIDE CONTAINING IODIDE

FIELD OF THE INVENTION

This invention relates to a heat developable color photographic material containing a dye-providing substance capable of providing a mobile dye by causing a reaction with a light-sensitive silver halide upon heating in a substantially water free state.

The invention also relates to a novel process of forming a dye image upon heating in a substantially water free state.

The invention further relates to a novel process of obtaining a dye image by transferring a dye released upon heating into a dye-fixing layer.

BACKGROUND OF THE INVENTION

Since a photographic process using silver halide is excellent in photographic properties such as sensitivity and gradation control as compared to other photographic processes such as electrophotography and diazo photographic processes, the silver halide photographic process has hitherto been most widely used. Recently, however, a technique capable of more easily and rapidly obtaining images has been developed by changing the image-forming process by a light-sensitive material using silver halide from a conventional wet process such as a process by a liquid developer to a dry process such as a developing process upon heating.

Heat developable photographic materials are known in the field of the art and these heat developable photographic materials and processes of processing them are described, in, for example, "Shashin Kogaku no Kiso (The Basis of Photographic Engineering)", pages 553–555, published by Corona K. K. in 1979; "Eizo Jooho (Image Information)", page 40, published on April 1978 "Neblett's Handbook of Photography and Reprography", 7th Ed., pages 32–33 (Van Nostrand Reinhold Company); U.S. Pat. Nos. 3,152,904; 3,301,678; 3,392,020; 3,457,075; British Pat. Nos. 1,131,108 and 1,167,777; and *Research Disclosure,* (RD-17029), pages 9–15, June, 1978.

Various processes have been proposed for obtaining color images. For example, for forming color images by a combination of the oxidation product of a developing agent and a coupler, there are proposed a combination of a p-phenylenediamine reducing agent and a phenolic or active methylene coupler in U.S. Pat. No. 3,531,286; p-aminophenol series reducing agents in U.S. Pat. No. 3,761,270; sulfoamidophenol series reducing agents in Belgian Patent No. 802,519 and *Research Disclosure,* pages 31 and 32, September, 1975; and a combination of a sulfoamidophenol series reducing agent and a 4-equivalent coupler in U.S. Pat. No. 4,021,240.

However, in these processes there is a fault that color images become turbid since images of reduced silver and color images are simultaneously formed at light exposed areas after heat development. For overcoming the fault, there are proposed a process of removing the silver images by liquid processing and a process of transferring the dyes only into other layer, for example, a sheet having an image-receiving layer. However, there remains a fault that it is not easy to discriminate a dye from the reaction mixture and transfer the dye only.

As an image-forming process of improving the foregoing fault, there is proposed a process of imagewise releasing a mobile dye by the oxidation reduction reaction with a light-sensitive silver halide and transferring the mobile dye onto a dye-fixing layer as disclosed in Japanese Patent Application (OPI) Nos. 58543/83; 79247/83; 149046/83; 149047/83, etc.

In the foregoing process of obtaining color images by a dry process, at the reduction of a light-sensitive silver halide into silver upon heating, a mobile dye is formed or released in chemical relation to the reaction but there is a fault that the reaction rate, that is, the heat developing rate during the process is slow. Also, in the foregoing process of obtaining color images by a dry system, an organic silver salt is sometimes used as one of the elements constituting a photographic material. However, in the case of dye-sensitizing such a photographic material by a sensitizing dye, the organic silver salt hinders the adsorption of the sensitizing dye onto the light-sensitive silver halide, which results in making difficult the performance of the dye sensitization.

SUMMARY OF THE INVENTION

An object of this invention is to provide a heat developable color photographic material showing the quick development thereof upon heating in a substantially water free state.

Another object of this invention is to provice a heat developable color photographic material having excellent color sensitivity even when using an organic silver salt.

The foregoing objects of this invention are attained by a heat developable color photographic material containing a light-sensitive silver halide, a binder, and a dye-providing substance capable of providing a mobile dye, when the foregoing silver halide is reduced to silver upon heating, in chemical relation to the reaction, wherein mixed crystal silver haloiodide having a silver iodide content of 4 mole% to 40 mole% is used as the foregoing silver halide.

DESCRIPTION OF THE PREFERRED EMBODIMENT

The mixed crystal silver haloiodide in this invention means a silver haloiodide which does not show the pattern of pure silver iodide in the X-ray diffraction. If the content of silver iodide is over 40 mole%, it becomes difficult to keep the mixed crystal state and hence the upper limit of the silver iodide content of the silver haloiodide in this invention is defined to be 40 mole%.

According to the inventor's discovery, the improvements in heat developing rate and color sensitivity are generally confirmed in case of employing the mixed crystal silver haloiodide having a silver iodide content of 4 mole% or more and particularly the improvements are remarkably confirmed in case of employing the mixed crystal silver haloiodide having a silver iodide content of 7 mole% or more. Taking into consideration also the fact that the emulsion is prepared with ease, particularly preferred silver iodide contents range between 7 mole% and 30 mole%.

There is no particular restriction on other halogen components of the mixed crystal silver haloiodide used in this invention but silver iodobromide or silver chloroiodobromide is a preferred halogen composition.

The mixed crystal silver haloiodide used in this invention can be prepared by the methods described in, for example, P. Glafkides; "Chimie et Physique Photographique" published by Paul Montel, 1967; G. F. Diffin; "Photographic Emulsion Chemistry", published by The Focal Press, 1966; V. L. Zelikman et al; "Marking and Coating Photographic Emulsions; published by The Focal Press 1964, etc. That is, an acid method, a neutralization method, an ammonia method, etc., may be used but an ammonia method is particularly preferred. Also, for reacting a soluble silver salt and a soluble halide, a single jet mixing method, a double jet mixing method, or a combination of these methods may be employed.

A method of forming silver halide grains in an excessive amount of silver ions (so-called reversal mixing method) can be also used. As one mode of double jet mixing methods, a so-called controlled double jet method, that is, a method of maintaining a constant pAg in a liquid phase in which silver halide grains are formed can be employed. According to the controlled double jet method, a so-called mono-dispersed silver halide emulsion having regular crystal form and almost uniform grain size is obtained and an image having hard gradation can be obtained by using such a silver halide emulsion.

After forming the precipitates of a silver halide or after the physical ripening of a silver halide emulsion, soluble salts are usually removed from the emulsion. For removing these salts, a well-known noodle-wash method wherein a silver halide emulsion is washed with water after gelling the gelatin of the emulsion may be used or a flocculation method utilizing an inorganic salt having a polyvalent anion (e.g., sodium sulfate, etc.,), an anionic surface active agent, an anionic polymer (e.g., polystyrenesulfonic acid, etc.,), or a gelatin derivative (e.g., aliphati acylated gelatin, aromatic cylated gelatin, aromatic carbamoyled gelatin, etc.,), may be used. As the case may be, the step of removing soluble salts may be omitted.

As the silver halide emulsion, a so-called primitive silver halide emulsion which is not chemically sensitized may be used in this invention but the silver halide emulsion used in this invention is usually chemically sensitized. For the chemical sensitization, the methods described in P. Glafkides: "Chimie et Physique Photographique"; published by Paul Montel, 1967; V. L. Zelikman et al "Marking and Coating Photographic Emulsion", published by The Focal Press, 1964; and "Die Grundlagen der Photographischen Prozesse mit Silverhalogeniden"; edited by H. Frieser; published by Akademische Verlagesgesellschaft, 1968 can be used. That is, a sulfur sensitization method using a sulfur-containing compound or active gelatin each capable of reacting with silver ions, a reduction sensitization method using a reducing substance, and a noble metal sensitization method using a noble metal compound such as a gold compound, etc., may be used solely or as a combination thereof.

As the sulfur sensitizing agent, thiosulfates, thioureas, thiazoles, rhodanines, etc., can be used and practical examples of them are described in, for example, U.S. Pat. Nos. 1,543,944; 2,410,689; 2,278,947; 2,728,668; 3,656,955; 4,032,928; 4,067,740, etc. As the reduction sensitizing agent, stannous salts, amines, hydrazine derivatives, formamiddinesulfinic acid; silane compounds, etc., can be used and practical examples of them are described in, for example, U.S. Pat. Nos. 2,487,850; 2,419,974; 2,518,698; 2,983,609; 2,983,610; 2,694,637; 3,930,867; 4,054,458, etc. For noble metal sensitization, gold complex salts as well as comples salts of other noble metals than gold, belonging to the group VIII of the periodic table, such as platinum, iridium, palladium, etc., can be used and practical examples of them are described in, for example, U.S. Pat. Nos. 2,399,083; 2,448,060; British Pat. No. 618,061, etc.

The mixed crystal silver haloiodide used in this invention is excellent in color sensitivity and hence is particularly suitable for silver halide emulsion layers which are subjected to color sensitization, such as so-called green-sensitive silver halide emulsion layers, red-sensitive silver halide emulsion layers, infrared sensitive silver halide emulsion layers, etc. In this case, for a silver halide emulsion layer which does not require color sensitization, such as a blue-sensitive silver halide emulsion layer, other light-sensitive silver halide than the mixed crystal silver haloiodide in this invention may be used.

The silver halide used in this invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleu, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is,, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 5-membered heterocyclic nuclei such as a pyrazolin-5-one-nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

Useful sensitizing dyes include those described in German Pat. No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Pat. No. 1,242,588, Japanese Patent Publication Nos. 14030/69 and 24844/77, etc.

These sensitizing dyes can be employed individually, and can also be employed in combination thereof. A combination of sensitizing dyes is often used, particularly for the purpose of supersensitization.

Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

In the particularly preferred embodiment of this invention, an organic silver salt oxidizing agent is used together. The organic silver salt oxidizing agent is a silver salt which forms a silver image by reacting with the above described dye-providing substnace or a reducing agent coexisting, if necessary, with the dye-providing substance, when it is heated to a temperature of above 80° C. and, preferably, above 100° C. in the presence of exposed silver halide. By coexisting the organic silver salt oxidizing agent, the light-sensitive material which provides higher color density can be obtained.

Examples of such organic silver salt oxidizing agents include the following compounds.

A silver salt of an organic compound having a carboxy group. Typical examples thereof include a silver salt of an aliphatic carboxylic acid and a silver salt of an aromatic carboxylic acid.

Examples of the silver salts of aliphatic carboxylic acids include silver behenate, silver stearate, silver oleate, silver laurate, silver caprate, silver myristate, silver palmitate, silver maleate, silver fumarate, silver tartarate, silver furoate, silver linolate, silver oleate, silver adipate, silver sebacate, silver succinate, silver acetate, silver butyrate and silver camphorate, etc. These silver salts which are substituted with a halogen atom or a hydroxy group are also effectively used.

Examples of the silver salts of aromatic carboxylic acid and other carboxyl group containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione, etc., as described in U.S. Pat. No. 3,785,830, and a silver salt of an aliphatic carboxylic acid containing a thioether group as described in U.S. Pat. No. 3,330,663, etc.

In addition, a silver salt of a compound containing a mercapto group or a thione group and a derivative thereof can be used.

Examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-mercaptobenzothiazole, a silver salt of 2-(S-ethylglycolamido)benzothiazole, a silver salt of thioglycolic acid such as a silver salt of an S-alkyl thioglycol acetic acid (wherein the alkyl group has from 12 to 22 carbon atoms) as described in Japanese Patent Application (OPI) No. 28221/73, a silver salt of dithiocarboxylic acid such as a silver salt of dithioacetic acid, a silver salt of thioamide, a silver salt of 5-carboxyl-1-methyl-2-phenyl-4-thiopyridine, a silver salt of mercaptotriazine, a silver salt of 2-mercaptobenzoxazole, a silver salt of mercaptooxadiazole, a silver salt as described in U.S. Pat. No. 4,123,274, for example, a silver salt of 1,2,4-mercaptotriazole derivative such as a silver salt of 3-amino-5-benzylthio-1,2,4-triazole, a silver salt of thione compound such as a silver salt of 3-(2-carboxyethyl)-4-methyl-4-thiazoline-2-thione as described in U.S. Pat. No. 3,301,678, and the like.

Further, a silver salt of a compound containing an imino group can be used. Examples of these compounds include a silver salt of benzotriazole and a derivative thereof as described in Japanese Patent Publication Nos. 30270/69 and 18316/70, for example, a silver salt of benzotriazole, a silver slat of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure*, Vol. 170, No. 17029 (June, 1979) and an organic metal salt such as copper stearate, etc., are the organic metal salt oxidizing agents capable of being used in the present invention.

Two or more organic silver salt oxidizing agents can be used together.

Methods of preparing these silver halide and organic silver salt oxidizing agents and manners of blending them are described in *Research Disclosure*, No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in this invention is in a total of from 50 mg/m$^2$ to 10 g/m$^2$ calculated as an amount of silver.

The light-sensitive silver halide and the organic silver salt oxidizing agent used in this invention are prepared in the binder as described below. Further, the dye-providing substance is dispersed in the binder described below.

The binder which can be used in this invention can be employed individually or in a combination thereof. A hydrophilic binder can be used as the binder according to this invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl pyrrolidone, acrylamide polymer, etc. Another example of the synthetic polymer compound is a dispersed vinyl compound in a latex form which is used for the purpose of increasing dimensional stability of a photographic material.

By the term "providing a mobile dye, when silver halide is reduced to silver, in chemical relation with the reaction" in this invention is meant that in, for example, a negative-type silver haloiodide emulsion, the center of development is formed in the silver halide by light exposure, the silver halide causes an oxidation reduction reaction with a reducing agent or a reducible dye-providing substance, and (1) the reducing agent is oxidized to form an oxidation product thereof, which reacts with a dye-providing substance capable of providing a mobile dye to form or release a mobile dye, (2) the reducing agent is oxidized and the remaining reducing agent causes an oxidation reduction reaction with the dye-providing substance capable of releasing a mobile dye by heating to form the reduction product of the dye-providing substance, said reduction product not releasing mobile dye, (3) the reducible dye-providing substance is oxidized, whereby releasing a mobile dye, (4) or the reducible dye-providing substance capable of releasing a mobile dye to from an oxidation product which does not release mobile dye. When using a positive-type silver halide emulsion in place of a negative-type silver halide emulsion, the foregoing reaction occurs at unexposed areas. In cases (1) and (3) a dye image in a positive relation to a silver image is obtained and in cases (2) and (4) a dye image in a negative reaction to a silver image is obtained.

As the dye-providing substance capable of providing a mobile dye, the following compounds can be used in this invention:

(1) A dye-providing substance capable of releasing a mobile dye by causing a reaction with the oxidation product of the reducing agent formed by the oxidation reduction reaction with silver halide occurring by heating (corresponding to the dye-providing substance releasing a mobile dye by foregoing reaction (1)).

The aforesaid dye-providing substance corresponding to the compounds described in Japanese Patent Application (OPI) No. 79247/83. These compounds are shown by general formula C-L-D, wherein D represents an image-forming dye moiety as described hereinafter, L represents a bonding group in which the C-L bonding is cleaved at the reaction of the oxidation product of the reducing agent, and C represents a moiety bonding to the oxidation product of the reducing agent, such as an active methylene, an active methine, a phenol residue, or a naphthol residue. C is preferably the groups shown by the following general formula (A) to (G).

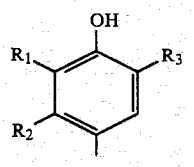
(A)

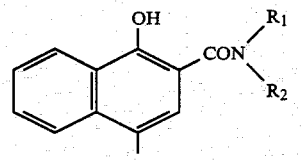
(B)

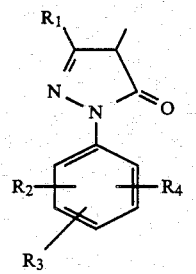
(C)

$R_1COCHCOR_2$
(D)

-continued

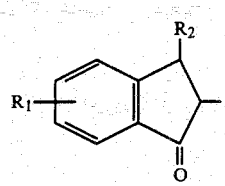
(E)

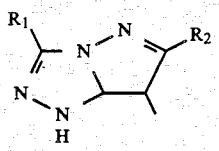
(F)

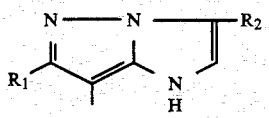
(G)

wherein $R_1$, $R_2$, $R_3$, and $R_4$ each represents a hydrogen atom, an alkyl group, a cycloalkyl group, an aryl group, an alkoxy group, an aryloxy group, an aralkyl group, an acyl group, an acylamino group, an alkoxyalkyl group, an aryloxyalkyl group, an N-substituted carbamoyl group, an alkylamino group, an arylamino group, a halogen atom, an acyloxy group, an acyloxyalkyl group, or a cyano group and these groups may further be substituted by a hydroxy group, a cyano group, a nitro group, an N-substituted sulfamoyl group, a carbamoyl group, an N-substituted carbamoyl group, an acylamino group, an alkylsulfonylamino group, an acylamino group, an alkylsulfonylamino group, an arylsulfonylamino group, an alkyl group, an aryl group, an alkoxy group, an aryloxy group, an aralkyl group, or an acyl group.

The moiety C must have an action of releasing a mobile dye by bonding to the oxidation product of the reducing agent and also have a ballast group for preventing the dye-providing substance itself from diffusing into a dye-receptive image-receiving layer. As the ballast group, such hydrophobic groups as an alkyl group, an alkoxyalkyl group, an aryloxyalkyl group, etc., are preferred. It is preferred that the total carbon atom number of the ballast group be 6 or more and the total carbon atom number of the moiety C be 12 or more.

(2) A coupler capable of forming a mobile dye by a coupling reaction with the oxidation product of the reducing agent formed by the oxidation reduction reaction with silver halide occurring by heating (corresponding to the dye-providing substance releasing a mobile dye by foregoing reaction (1)).

As the coupler, there are couplers described in Japanese Patent Application (OPI) Nos. 149046/83 and 149047/83 further having a releasable group having a non-diffusible group sufficient for rendering these couplers non-diffusible.

(3) A compound which releases a mobile dye by heating but becomes a compound of not releasing mobile dye by the oxidation reduction reaction with silver halide occurring by heating (corresponding to the dye-providing substances used for the foregoing reactions (2) and (4)).

As the dye-providing substances used for reaction (2), there are compounds causing an intramolecular nucleophilic reaction described in U.S. Pat. No. 4,139,379.

As the dye-providing substances used for reaction (4), there are the oxidation products of the nucleophilic groups of the compounds described in U.S. Pat. No. 4,139,379.

(4) A dye-providing substance reductive to silver halide capable of releasing a mobile dye by the oxidation reduction reaction with silver halide occurring by heating (corresponding to the dye-providing substance used for foregoing reaction (3)).

The aforesaid dye-providing substance corresponding to the compounds described in Japanese Patent Application (OPI) No. 58543/83. These compounds are shown by the following general formula.

$$Ra\text{-}SO_2\text{-}D \quad (I)$$

wherein Ra represents a reducing group capable of being oxidized by the silver halide; and D represents an image forming dye portion containing a hydrophilic group.

Preferably the reducing group Ra in the dye providing substance $Ra\text{-}SO_2\text{-}D$ has an oxidation-reduction potential to a saturated calomel electrode of 1.2 V or less measuring the polarographic half wave potential using acetonitrile as a solvent and sodium perchlorate as a base electrolyte. Preferred examples of the reducing group Ra include those represented by the following general formula (II) to (IX).

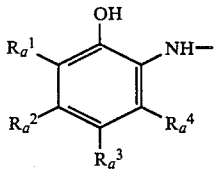
(II)

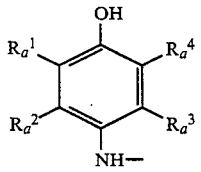
(III)

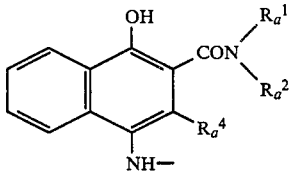
(IV)

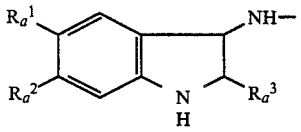
(V)

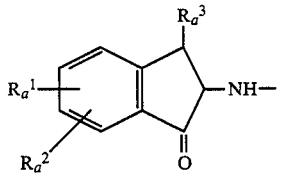
(VI)

-continued

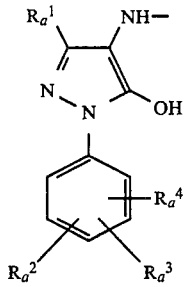
(VII)

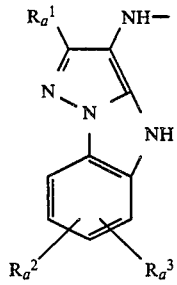
(VIII)

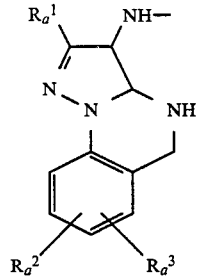
(IX)

wherein $R_a^1$, $R_a^2$, $R_a^3$ and $R_a^4$ each represents a hydrogen atom or a substituent selected from an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group, an N-substituted sulfamoyl group, a halogen atom, an alkylthio group or an arylthio group. The alkyl moiety and the aryl moiety in the above described substituents may be further substituted with an alkoxy group, a halogen atom, a hydroxy group, a cyano group, an acyl group, an acylamino group, a substituted carbamoyl group, a substituted sulfamoyl group, an alkylsulfonylamino group, an arylsulfonylamino group, a substituted ureido group or a carboalkoxy group. Furthermore, the hydroxy group and the amino group included in the reducing group represented by Ra may be protected by a protective group capable of reproducing the hydroxy group and the amino group by the action of a nucleophilic agent.

In more preferred embodiments of this invention, the reducing group Ra is represented by the following general formula (X)

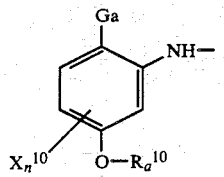

(X)

wherein Ga represents a hydroxy group or a group giving a hydroxy group upon hydrolysis; $R_a^{10}$ represents an alkyl group or an aromatic group; n represents an integer of 1 to 3; $X^{10}$ represents an electron donating substituent when n is 1 or substituents, which may be the same or different, one of the substituents being an electron donating group and the second or second and third substituents being selected from an electron donating group or a halogen atom when n is 2 or 3, respectively; wherein $X^{10}$ groups may form a condensed ring with each other or with $OR_a^{10}$; and the total number of the carbon atoms included in $R_a^{10}$ and $X_n^{10}$ is not less than 8.

Of the reducing groups represented by the general formula (X), more preferred reducing groups Ra are represented by the following general formulae (Xa) and (Xb):

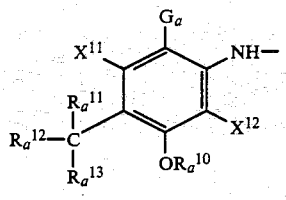

(Xa)

wherein Ga represents a hydroxy group or a group giving a hydroxy group upon hydrolysis; $R_a^{11}$ and $R_a^{12}$, which may be the same or different, each represents an alkyl group or $R_a^{11}$ and $R_a^{12}$ may be bonded to each other to form a ring; $R_a^{13}$ represents a hydrogen atom or an alkyl group; $R_a^{10}$ represents an alkyl group or an aromatic group; $X^{11}$ and $X^{12}$, which may be the same or different, each represents a hydrogen atom, an alkyl group, an alkoxy group, a halogen atom, an acylamino group or an alkylthio group; and $R_a^{10}$ and $X^{12}$ or $R_a^{10}$ and $R_a^{13}$ may be bonded to each other to form a ring,

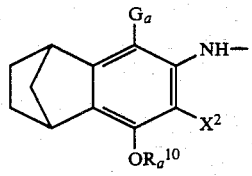

(Xb)

wherein Ga represents a hydroxy group or a group giving a hydroxy group upon hydrolysis; $R_a^{10}$ represents an alkyl group or an aromatic group; $X^2$ represents a hydrogen atom, an alkyl group, an alkoxy group, a halogen atom, an acylamino group or an alkylthio group; and $X^2$ and $R_a^{10}$ may be bonded to each other to form a ring.

Specific examples of the reducing groups represented by the above described general formulae (X), (Xa) and (Xb) are described in U.S. Pat. No. 4,055,428, Japanese Patent Application (OPI) Nos. 12642/81 and 16130/81, respectively.

In other more preferred embodiments of this invention, the reducing group Ra is represented by the following general formula (XI).

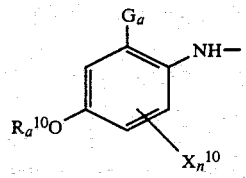

(XI)

wherein Ga, $X^{10}$, $R_a^{10}$ and n each has the same meaning as Ga, $X^{10}$, $R_a^{10}$ and n defined in the general formula (X).

Of the reducing groups represented by the general formula (XI), more preferred reducing groups Ra are represented by the following general formula (XIa), (XIb) and (XIc)

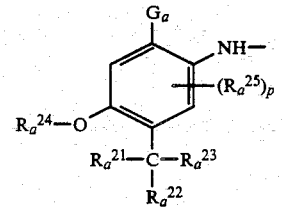

(XIa)

wherein Ga represents a hydroxy group or a group giving a hydroxy group upon hydrolysis; $R_a^{21}$ and $R_a^{22}$, which may be the same or different, each represents an alkyl group or an aromatic group, and $R_a^{21}$ and $R_a^{22}$ may be bonded to each other to form a ring; $R_a^{23}$ represents a hydrogen atom, an alkyl group or an aromatic group; $R_a^{24}$ represents an alkyl group or an aromatic group; $R_a^{25}$ represents an alkyl group, an alkoxy group, an alkylthio group, an arylthio group, a halogen atom or an acylamino group; p is 0, 1 or 2; $R_a^{24}$ and $R_a^{25}$ may be bonded to each other to form a condensed ring; $R_a^{21}$ and $R_a^{24}$ may be bonded to each other to form a condensed ring; $R_a^{21}$ and $R_a^{25}$ may be bonded to each other to form a condensed ring; and the total number of the carbon atoms included in $R_a^{21}$, $R_a^{22}$, $R_a^{23}$, $R_a^{24}$ and $(R_a^{25})_p$ is more than 7.

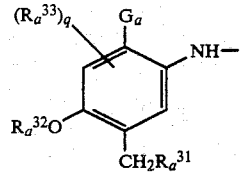

(XIb)

wherein Ga represents a hydroxy group or a group giving a hydroxy group upon hydrolysis; $R_a^{31}$ represents an alkyl group or an aromatic group; $R_a^{32}$ represents an alkyl group or an aromatic group; $R_a^{33}$ represents an alkyl group, an alkoxy group, an alkylthio group, an arylthio group, a halogen atom or an acylamino group; q is 0, 1 or 2; $R_a^{32}$ and $R_a^{33}$ may be bonded to each other to form a condensed ring; $R_a^{31}$ and $R_a^{32}$ may be bonded to each other to form a condensed ring; $R_a^{31}$ and $R_a^{33}$ may be bonded to each other to form a condensed ring; and the total number of the carbon atoms included in $R_a^{31}$, $R_a^{32}$ and $(R_a^{33})_q$ is more than 7.

(XIc)

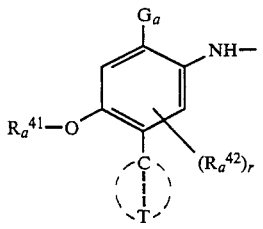

wherein Ga represents a hydroxy group or a group giving a hydroxy group upon hydrolysis; $R_a^{41}$ represents an alkyl group or an aromatic group; $R_a^{42}$ represents an alkyl group, an alkoxy group, an alkylthio group, an arylthio group, a halogen atom or an acylamino group; r is 0, 1 or 2; the group of

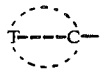

represents a group in which 2 to 4 saturated hydrocarbon rings are condensed, the carbon atom

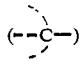

in the condensed ring which is connected to the phenol nucleus (or a precursor thereof), represents a tertiary carbon atom which composes one of the pivot of the condensed ring, a part of the carbon atoms (excluding the above described tertiary carbon atom) in the hydrocarbon ring may be substituted for oxygen atom(s), the hydrocarbon ring may have a substituent, and an aromatic ring may be further condensed to the hydrocarbon ring; $R_a^{41}$ or $R_a^{42}$ and the group of

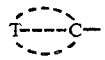

may be bonded to each other to form a condensed ring; and the total number of the carbon atoms included in $R_a^{41}$, $(R_a^{42})_r$ and the group of

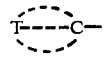

is not less than 7.

Specific examples of the reducing groups represented by the above described general formulae (XI), (XIa), (XIb) and (XIc) are described in Japanese Patent Application (OPI) Nos. 16131/81, 650/82 and 4043/82.

The essential part in the groups represented by the general formulae (III) and (IV) is a para(sulfonyl-)aminophenol part. Specific examples of these reducing groups are described in U.S. Pat. Nos. 3,928,312 and 4,076,529, U.S. Published patent application B Ser. No. 351,673, U.S. Pat. Nos. 4,135,929 and 4,258,120. These groups are also effective for the reducing group Ra according to the this invention.

In still other more preferred embodiments of this invention, the reducing group Ra is represented by the following general formula (XII).

(XII)

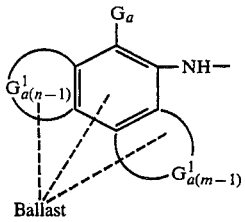

wherein Ballast represents a diffusion-resistant group; Ga represents a hydroxy group or a precursor of a hydroxy group; $G_a^1$ represents an aromatic ring directly condensed to the benzene nucleus to form a naphthalene nucleus; and n and m are dissimilar positive integers of 1 to 2.

Specific examples of the reducing groups represented by the above described general formula (XII) are described in U.S. Pat. No. 4,053,312.

The reducing groups represented by the above described general formulae (V), (VII), (VIII) and (IX) are characterized by containing a heterocyclic ring. Specific examples of the groups are described in U.S. Pat. No. 4,198,235, Japanese Patent Application (OPI) No. 46730/78 and U.S. Pat. No. 4,273,855.

Specific examples of the reducing groups represented by the general formula (VI) are described in U.S. Pat. No. 4,149,892.

Characteristics required for the reducing group Ra are as follows.

1. It is rapidly oxidized by the silver halide to effectively release a diffusible dye for image formation by the function of the dye releasing activator.

2. The reducing group Ra has an extensive hydrophobic property, because it is necessary for the dye providing substance to be diffusion-resistant in a hydrophilic or hydrophobic binder and that only the released dye has diffusibility.

3. It has excellent stability to heat and to the dye releasing activator and does not release the image forming dye until it is oxidized; and 4. It is easily synthesized.

Examples of dyes which can be used for image forming dye include azo dyes, azomethine dyes, anthraquinone dyes, naphthoquinone dyes, styryl dyes, nitro dyes, quinoline dyes, carbonyl dyes and phthalocyanine dyes, etc. Representative examples of them are set forth below and are classified by hue. Further, these dyes can be used in a form temporarily shifted to shorter wavelength region which is capable of regeneration during the development processing.

Yellow:

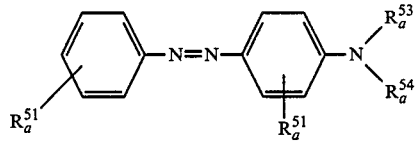

-continued
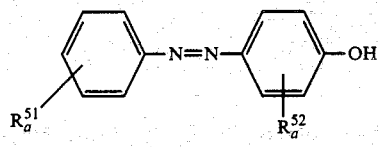
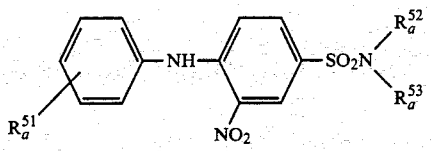
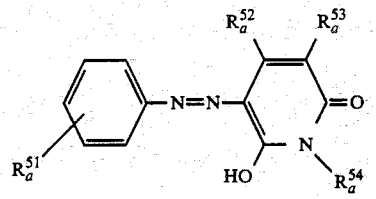
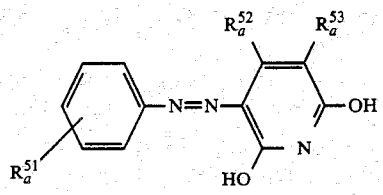
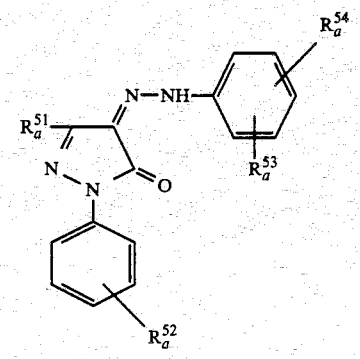
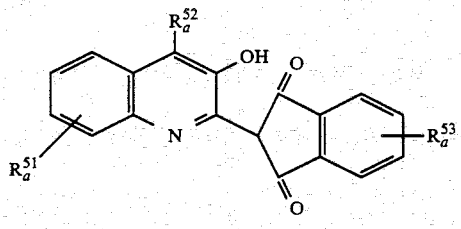
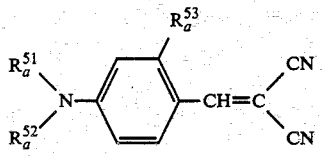
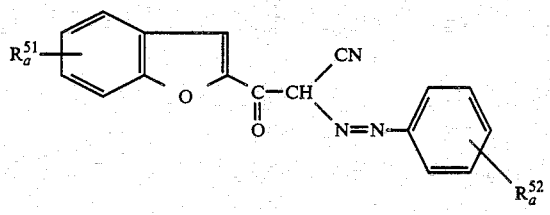
-continued
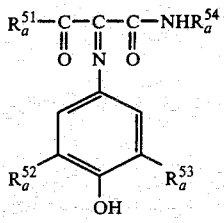
Magenta:
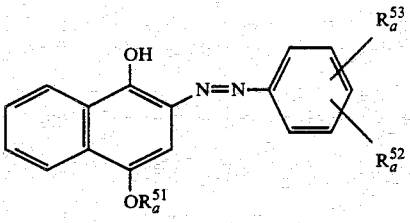
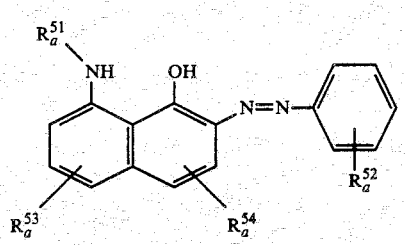
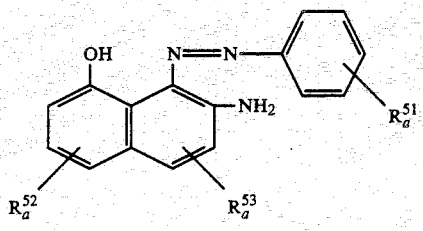
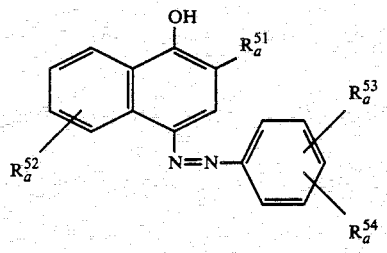
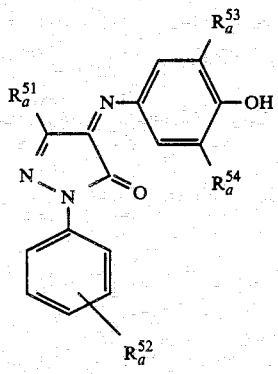

-continued
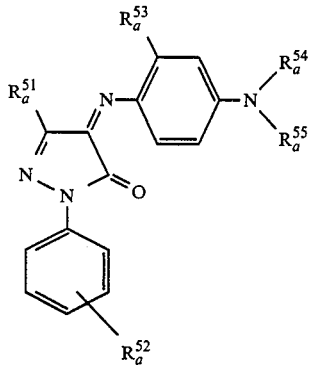
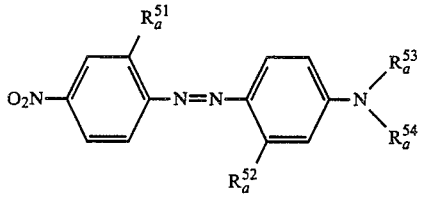
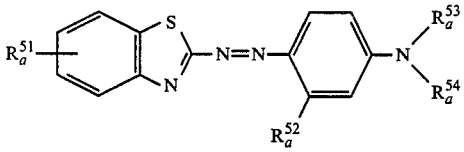
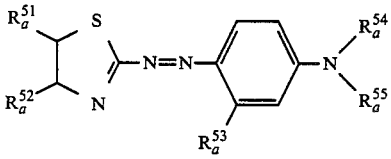
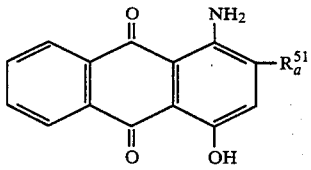
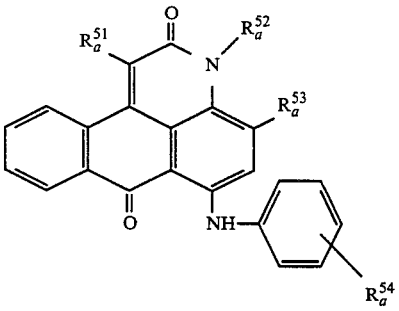
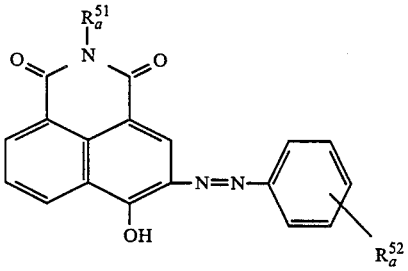
-continued
Cyan:
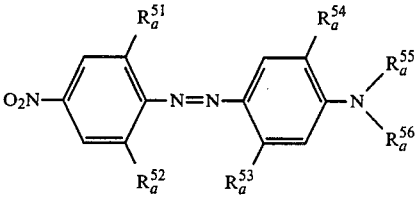
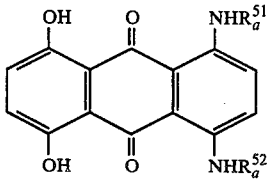
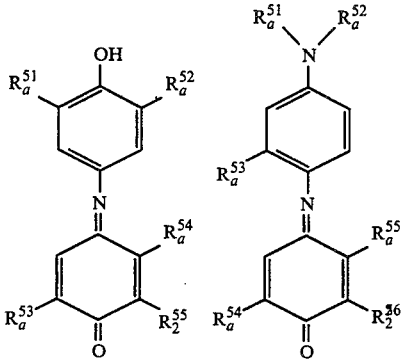
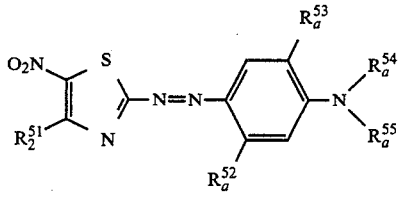
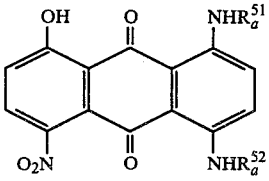
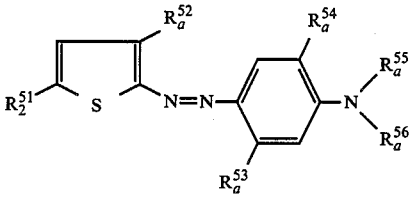
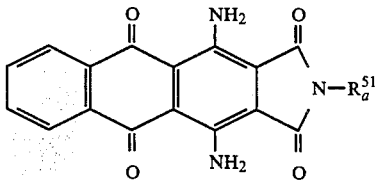

-continued

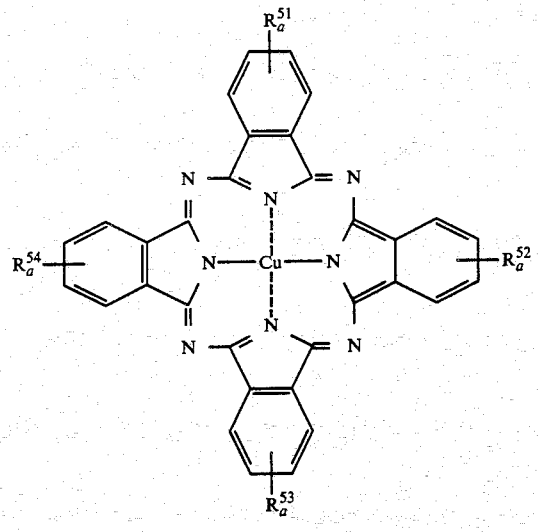

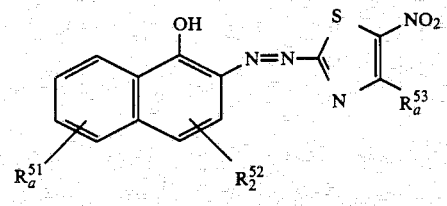

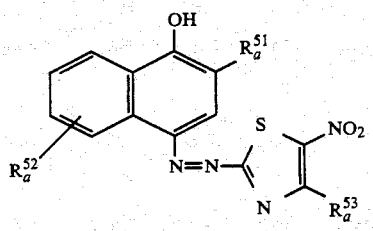

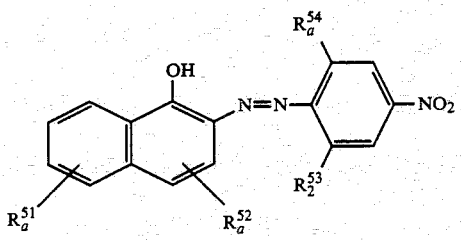

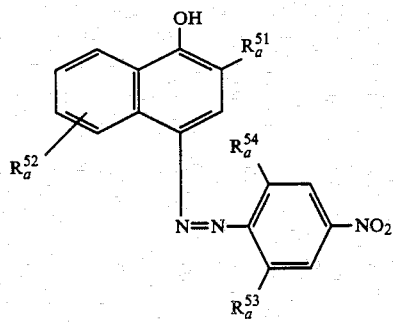

In the above described formulae, $R_a^{51}$ to $R_a^{56}$ each represents a hydrogen atom or a substituent selected from an alkyl group, a cycloalkyl group, an aralkyl group, an alkoxy group, an aryloxy group, an aryl group, an acylamino group, an acyl group, a cyano group, a hydroxyl group, an alkylsulfonylamino group, an arylsulfonylamino group, an alkylsulfonyl group, a hydroxyalkyl group, a cyanoalkyl group, an alkoxycarbonylalkyl group, an alkoxyalkyl group, an aryloxyalkyl group, a nitro group, a halogen atom, a sulfamoyl group, an N-substituted sulfamoyl group, a carbamoyl group, an N-substituted carbamoyl group, an acykloxyalkyl group, an amino group, a substituted amino group, an alkylthio group or an arylthio group. The alkyl moiety and the aryl moiety in the above described substituents may be further substituted with a halogen atom, a hydroxy group, a cyano group, an acyl group, an acylamino group, an alkoxy group, a carbamoyl group, a substituent carbamoyl group, a sulfamoyl group, a substituted sulfamoyl group, a carboxy group, an alkylsulfonylamino group, an arylsulfonylamino group or a ureido group.

Examples of the hydrophilic groups include a hydroxy group, a carboxy group, a sulfo group, a phosphoric acid group, an imido group, a hydroxamic acid group, a quaternary ammonium group, a carbamoyl group, a substituted carbamoyl group, a sulfamoyl group, a substituted sulfamoyl group, a sulfamoylamino group, a substituted sulfamoylamino group, a ureido group, a substituted ureido group, an alkoxyy group, a hydroxyalkoxy group, an alkoxyalkoxy group, etc.

In this invention, those in which the hydrophilic property thereof is increased by dissociation of a proton under a basic condition are particularly preferred. Examples of these groups include a phenolic hydroxy group, a carboxy group, a sulfo group, a phosphoric acid group, an imido group, a hydroxamic acid group, a (substituted) sulfamoyl group, a (substituted) sulfamoylamino group, etc.

Characteristics required for the image forming dye are as follows.

1. It has a hue suitable for color reproduction.

2. It has a large molecular extinction coefficient.

3. It is fast to light and heat and stable for the dye releasing activator and other additives included in the system; and 4. It is easily synthesized.

Specific examples of preferred image forming dyes are described in European Patent Application (OPI) No. 76,492.

In the following, specific examples of the preferred dye providing substances are described.

(1)
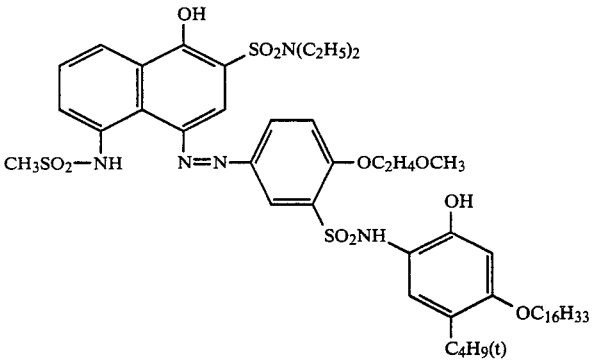
(2)
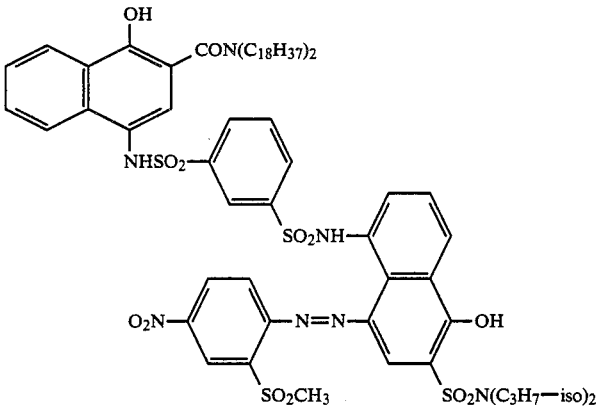
(3)
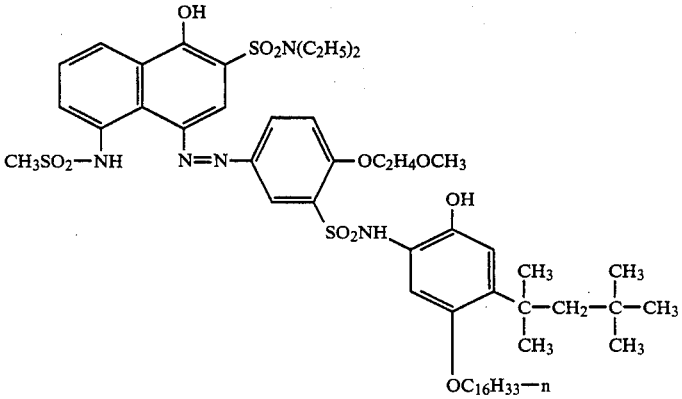
(4)
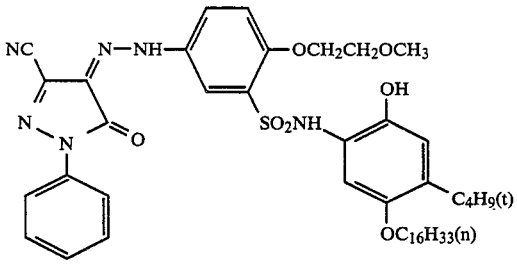
(5)
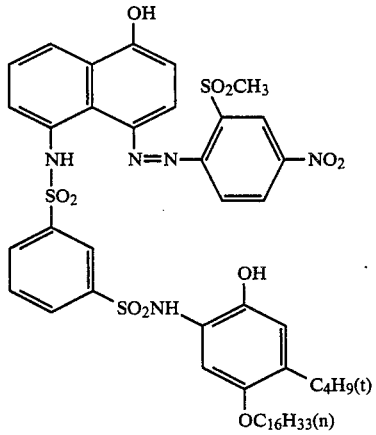

-continued
(6)
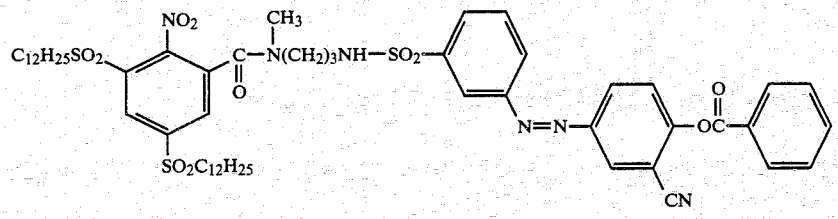
(7)
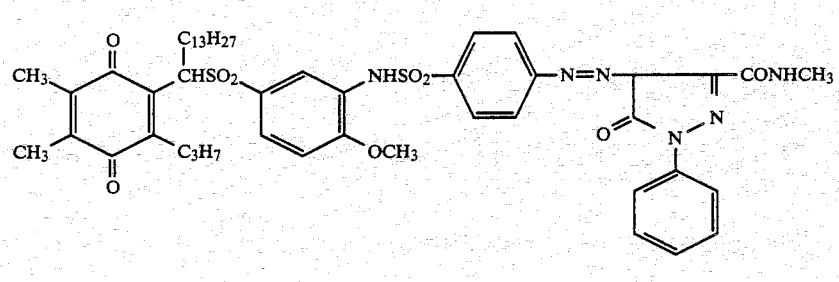
(8)
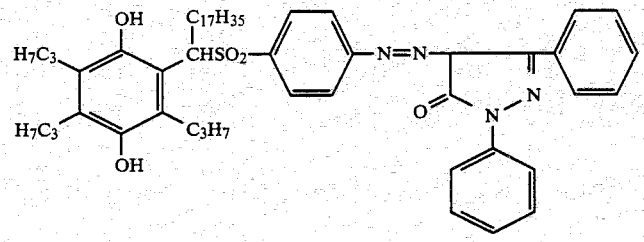
(9)
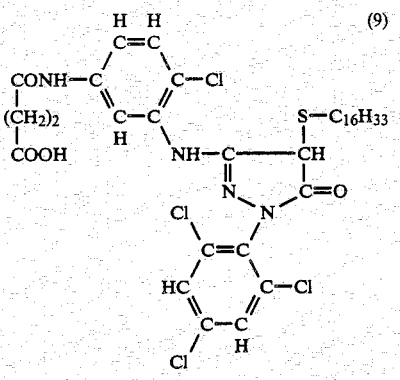
(10)
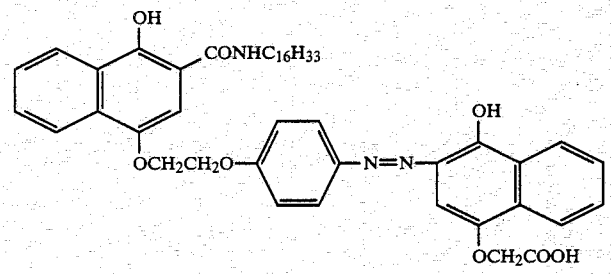
(11)
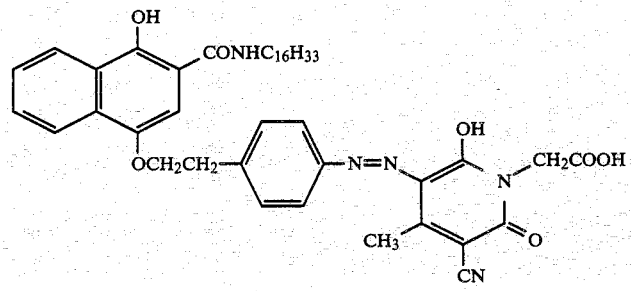

-continued (12)

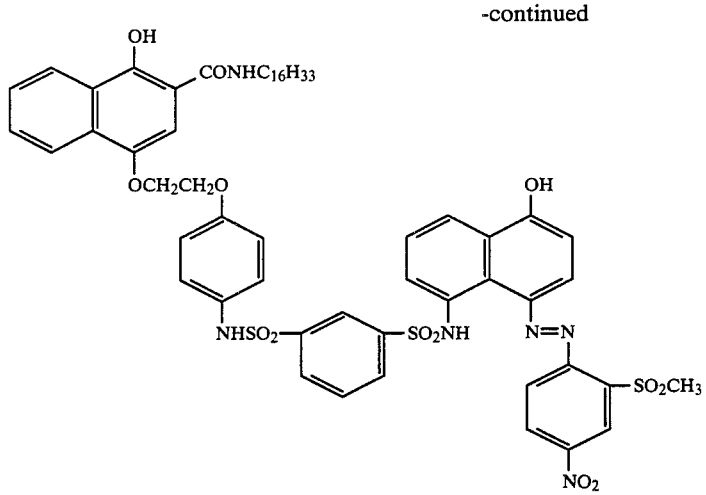

As the dye providing substance used in this invention, the compounds as described, for example, in U.S. Pat. No. 4,055,428, Japanese Patent Application (OPI) Nos. 12642/81, 16130/81, 16131/81, 650/82 and 4043/82, U.S. Pat. Nos. 3,928,312 and 4,076,529, U.S. Published patent application B Ser. No. 351,673, U.S. Pat. Nos. 4,135,929 and 4,198,235, Japanese Patent Application (OPI) No. 46730/78, U.S. Pat. Nos. 4,273,855, 4,149,892, 4,142,891 and 4,258,120, etc., are also effective in addition to the above described specific examples.

Further, the dye providing substance which release a yellow dye as described, for example, in U.S. Pat. Nos. 4,013,633, 4,156,609, 4,148,641, 4,165,987, 4,148,643, 4,183,755, 4,246,414, 4,268,625 and 4,245,028, Japanese Patent Application (OPI) Nos. 71072/81, 25737/81, 138744/80, 134849/80, 106727/77, 114930/76, etc., can be effectively used in this invention.

The dye providing substances which release a magenta dye as described, for example, in U.S. Pat. Nos. 3,954,476, 3,932,380, 3,931,144, 3,932,381, 4,268,624 and 4,255,509, Japanese Patent Application (OPI) Nos. 73057/81, 71060/81, 134850/80, 40402/80, 36804/80, 23628/78, 106727/77, 33142/80 and 53329/80, etc., can be effectively used in this invention.

The dye providing substances which release a cyan dye as described, for example, in U.S. Pat. Nos. 3,929,760, 4,013,635, 3,942,987, 4,273,708, 4,148,642, 4,183,754, 4,147,544, 4,165,238, 4,246,414 and 4,268,625, Japanese Patent Application (OPI) Nos. 71061/81, 47823/78, 8827/77 and 143323/78, etc., can be effectively used in this invention.

Two or more of the dye providing substances can be used together. In these cases, two or more dye releasing redox compounds may be used together in order to represent the same hue or in order to represent black color.

The dye-providing substances are suitably used in a range from 10 mg/m$^2$ to 15 g/m$^2$ and preferably in a range from 20 mg/m$^2$ to 10 g/m$^2$ in total.

In this invention, a mobile dye is imagewise released or formed form a dye providing substance while chemically reacting with exposed silver halide. This reaction occurs in a high temperature and a substantially water free state. The high temperature hereinbefore means a temperature state of 80° C. or more and the dry state where water is substantially free means the state where the water content in a system is equilibrated with moisture in air but water is not supplied from outside the system. The state is described in "The theory of the photographic process" 4th Ed. (Edited by T. H. James, Macmillan) P. 374. It has been confirmed from such a fact that the reaction rate of samples dried at $10^{-3}$ mmHg for 1 hour is not decreased such that a sufficient reaction rate is obtained in a substantially water free state.

The reaction of this invention is especially improved in the presence of an organic silver salt oxidizing agent to provide a high image density. Accordingly, it is particularly preferred to further incorporate the organic silver salt oxidizing agent.

The reducing agents used in this invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

More preferred reducing agents include the following compounds.

3-Pyrazolidone compounds (for example, 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 5-methyl-3-pyrazolidone).

Various combinations of developing agents as described in U.S. Pat. No. 3,039,869 can also be used.

In this invention, the amount of reducing agent added is from 0.01 mol to 20 mols per mol of silver and more preferably from 0.1 mol to 10 mols per mol of silver.

The dye releasing redox compound used in this invention can be introduced into a layer of the light-sensitive material by known methods such as a method as described in U.S. Pat. No. 2,322,027. In this case, an organic solvent having a high boiling point or an organic solvent having a low boiling point as described below can be used. For example, the dye releasing redox compound is dispersed in a hydrophilic colloid after being dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, β-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye releasing redox compound is dispersed in a hydrophilic colloid. For this purpose, the surface active agents illustrated in other part of the specification can be used.

The amount of the organic solvent having a high boiling point used in this invention is 10 g per g of the dye releasing redox compound used or less and preferably 5 g per g or less.

In this invention, if necessary, the so-called auxiliary developing agent can be used even when the reducible dye providing substance is used. The auxiliary developing agent in this case is a compound which is oxidized upon the silver halide to form its oxidized product having an ability to oxidize the reducing group Ra in the dye providing substance.

Examples of useful auxiliary developing agents include hydroquinone, alkyl substituted hydroquinones such as tertiary butylhydroquinone, 2,5-dimethylhydroquinone, etc., catechols, pyrogallols, halogen substituted hydroquinones such as chlorohydroquinone, dichlorohydroquinone, etc., alkoxy substituted hydroquinones such as methoxyhydroquinone, and polyhydroxybenzene derivatives such as methyl hydroxynaphthalene, etc. Further, methyl gallate, ascorbic acid, ascorbic acid derivatives, hydroxylamines such as N,N-di(2-ethoxyethyl)hydroxylamine, etc., pyrazolidones such as 1-phenyl-3-pyrazolidone, 4-methyl-4-hydroxymethyl-1-phenyl-3-pyrazolidone, etc., reductones and hydroxy tetronic acids are useful.

The auxiliary developing agent can be used in an amount of a fixed range. A suitable range is 0.0005 time by mol to 20 times by mol based on silver. A particularly suitable range is 0.001 time by mol to 4 times by mol.

A support used in the this invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. The polyesters described in U.S. Pat. Nos. 3,634,089 and 3,725,070 are preferably used.

In this invention, various kinds of dye releasing activator can be used. The dye releasing activator means a substance which accelerates the oxidation-reduction reaction between the light-sensitive silver halide and/or the organic silver salt oxidizing agent and dye providing substance or accelerates release of a dye by means of its nucleophilic action to the oxidized dye providing substance in the dye releasing reaction subsequently occurred, and a base and a base precursor can be used. It is particularly advantageous to use these dye releasing activators in order to accelerate the reactions in this invention.

Examples of preferred bases are amines which include trialkylamines, hydroxylamines, aliphatic polyamines, N-alkyl substituted aromatic amines, N-hydroxyalkyl substituted aromatic amines and bis[p-(dialkylamino)phenyl]methanes. Further, there are betaine tetramethylammonium iodide and diaminobutane dihydrochloride as described in U.S. Pat. No. 2,410,644, and urea and organic compounds including amino acids such as 6-aminocaproic acid as described in U.S. Pat. No. 3,506,444. The base precursor is a substance which releases a basic component by heating. Examples of typical base precursors are described in British Pat. No. 998,949. A preferred base precursor is a salt of a carboxylic acid and an organic base, and examples of the suitable carboxylic acids include trichloroacetic acid and trifluoroacetic acid and examples of the suitable bases include guanidine, piperidine, morpholine, p-toluidine and 2-picoline, etc. Guanidine trichloroacetate as described in U.S. Pat. No. 3,220,846 is particularly preferred. Further, aldonic amides as described in Japanese Patent Application (OPI) No. 22625/75 are preferably used because they decompose at a high temperature to form bases.

These dye releasing activators can be used in an amount of a broad range. A useful range is up to 50% by weight based on the amount of a dry layer coated of the photographic material. A range of 0.01% by weight to 40% by weight is more preferred.

It is advantageous to use a compound represented by the general formula described below in the heat-developable color photographic material in order to accelerate development and accelerate release of a dye.

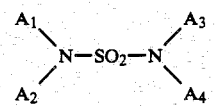

(A)

wherein $A_1$, $A_2$, $A_3$ and $A_4$, which may be the same or different, each represents a hydrogen atom or a substituent selected from an alkyl group, a substituted alkyl group, a cycloalkyl group, an aralkyl group, an aryl group, a substituted aryl group and a heterocyclic group; and $A_1$ and $A_2$ or $A_3$ and $A_4$ may combine with each other to form a ring.

Specific examples of the compounds include $H_2NSO_2NH_2$, $H_2NSO_2N(CH_3)_2$, $H_2NSO_2N(C_2H_5)_2$, $H_2NSO_2NHCH_3$, $H_2NSO_2N(C_2H_4OH)_2$, $CH_3NHSO_2NHCH_3$,

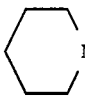

$NSO_2NH_2$, etc.

The above described compound can be used in an amount of broad range. A useful range is up to 20% by weight based on the amount of a dry layer coated of the light-sensitive material. A range of 0.1% by weight to 15% by weight is more preferred.

It is advantageous to use a water releasing compound in this invention in order to accelerate the dye releasing reaction.

The water releasing compound means a compound which releases water by decomposition during heat development. These compounds are particularly known in the field of printing of fabrics, and $NH_4Fe(SO_4)_2.12H_2O$, etc., as described in Japanese Patent Application (OPI) No. 88386/75 are useful.

Further, in the this invention, it is possible to use a compound which activates development simultaneously while stabilizing the image. Particularly, it is preferred to use isothiuroiums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

In this invention, it is possible to use a thermal solvent. The term "thermal solvent" means a non-hydrolyzable organic material which is solid at an ambient temperature but melts together with other components at a temperature of heat treatment or below. Preferred examples of thermal solvents include compounds which can act as a solvent for the developing agent and compounds having a high dielectric constant which accelerate physical development of silver salts. Examples of preferred thermal solvents include polyglycols as described in U.S. Pat. No. 3,347,675, for example, polyethylene glycol having an average molecular weight of 1,500 to 20,000, derivatives of polyethylene oxide such as polyethylene oxide oleic acid ester, etc., beeswax, monostearin, compounds having a high dielectric constant which have an —$SO_2$— or —CO— group such as acetamide, succinimide, ethylcarbamate, urea, methylsulfonamide or ethylene carbonate, polar substances as described in U.S. Pat. No. 3,667,959, lactone of 4-hydroxybutanoic acid, methylsulfinylmethane, tetrahydrothiophene-1,1-dioxide, and 1,10-decanediol, methyl anisate and biphenyl suberate as described in *Research Disclosure,* pages 26 to 28 (December, 1976), etc.

In this invention, though it is not so necessary to further incorporate substances or dyes for preventing irradiation or halation in the light-sensitive material, because the light-sensitive material is colored by the dye providing substance, it is possible to add filter dyes or light absorbing materials, etc., as described in Japanese Patent Publication No. 3692/73 and U.S. Pat. Nos. 3,253,921, 2,527,583 and 2,956,879, etc., in order to further improve sharpness. It is preferred that these dyes have a thermal bleaching property. For example, dyes as described in U.S. Pat. Nos. 3,769,019, 3,745,009 and 3,615,432 are preferred.

The light-sensitive material used in this invention may contain, if necessary, various additives known for the heat-developable light-sensitive materials and may have a layer other than the light-sensitive layer, for example, an antistatic layer, an electrically conductive layer, a protective layer, an intermediate layer, an antihalation layer, a strippable layer, etc.

The photographic emulsion layer and other hydrophilic colloid layers in the light-sensitive material of this invention may contain various surface active agents for various purposes, for example, as coating aids or for prevention of electrically charging, improvement of lubricating property, emulsification, prevention of adhesion, improvement of photographic properties (for example, acceleration of development, rendering hard tone or sensitization), etc.

For example, it is possible to use nonionic surface active agents such as saponin (steroid), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamine or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonic acid salts, alkylbenzenesulfonic acid salts, alkylnaphthalenesulfonic acid salts, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol type nonionic surface active agents having a recurring unit of ethylene oxide in their molecules may be preferably incorporated into the light-sensitive material. It is particularly preferred that the molecule contains 5 or more of the recurring units of ethylene oxide.

The nonionic surface active agents capable of satisfying the above described conditions are well known as to their structures, properties and methods of synthesis. These nonionic surface active agents are widely used even outside this field. Representative references relating to these agents include: *Surfactant Science Series,* Vol. 1, Nonionic Surfactants (edited by Martin J. Schick, Marcel Dekker Inc., 1967), and *Surface Active Ethylene Oxide Adducts,* (edited by Schoufeldt N. Pergamon Press, 1969). Among the nonionic surface active agents described in the above mentioned references, those capable of satisfying the above described conditions are preferably employed in connection with the present invention.

The nonionic surface active agents can be used individually or as a mixture of two or more of them.

The polyethylene glycol type nonionic surface active agents can be used in an amount of less than 100% by weight, preferably less than 50% by weight, based on a hydrophilic binder.

The light-sensitive material of this invention may contain a cationic compound containing a pyridinium salt. Examples of the cationic compounds containing a pyridinium group used are described in PSA Journal Section B 36 (1953), U.S. Pat. Nos. 2,648,604 and 3,671,247, Japanese Patent Publication Nos. 30074/69 and 95023/69, etc.

In the photographic light-sensitive material and the dye fixing material of this invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

Examples of various additives include those described in *Research Disclosure,* Vol. 170, No. 17029 (June, 1978), for example, plasticizers, dyes for improving sharpness, antihalation dyes, sensitizing dyes, matting agents, fluorescent whitening agents and fading preventing agent, etc.

The protective layer, the intermediate layer, the subbing layer, the back layer and other layers can be produced by preparing each coating solution and applying to a support by various coating methods such as a dip coating method, an air-knife coating method, a curtain coating method or a hopper coating method as described in U.S. Pat. No. 2,681,294 and drying in the same manner as used in preparing the heat-developable light-sensitive layer of this invention, by which the light-sensitive material is obtained.

If necessary, two or more layers may be applied at the same time by the method as described in U.S. Pat. No. 2,761,791 and British Pat. No. 837,095.

Various means of exposure can be used in this invention. Latent images are obtained by image-wise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light-emitting diodes, etc.

The original may be line drawings or photographs having gradation. Further, it is possible to take a photograph of a portrait or landscape by means of a camera. Printing from the original may be carried out by contact printing by superposing the original on the material or may be carried out by reflection printing or enlargement printing.

It is also possible to carry out the printing of images photographed by a videocamera or image informations sent from a television broadcasting station by displaying on a cathode ray tube (CRT) or a fiber optical tube (FOT) and focusing the resulting image on the heat-developable photographic material by contacting therewith or by means of a lens.

Recently, light-emitting diode (LED) systems which have been greatly improved have begun to be utilized as an exposure means or display means for various apparatus and devices. It is difficult to produce an LED which effectively emits blue light. In this case, in order to reproduce the color image, three kinds of LEDs consisting of those emitting each green light, red light and infrared light are used. The light-sensitive material to be sensitized by these lights is produced so as to release a yellow dye, a magenta dye and a cyan dye, respectively.

The light-sensitive material is produced using a construction such that the green-sensitive part (layer) contains a yellow dye providing substance, the red-sensitive part (layer) contains a magenta dye providing substance and the infrared-sensitive part (layer) contains a cyan dye providing substance. Other combinations can be utilized, if necessary.

In addition to the above described methods of contacting or projecting the original, there is a method of exposure wherein the original illuminated by a light source is stored in a memory of a reading computer by means of a light-receiving element such as a phototube or a charge coupling device (CCD). The information is, if necessary, subjected to processing, the so-called image treatment, and resulting image information is reproduced on CRT which can be utilized as an image-like light source or lights are emitted by three kinds of LED according to the processed information.

After the heat-developable color photographic material is exposed to light, the resulting latent image can be developed by heating the whole material to a suitably elevated temperature, for example, about 80° C. to about 250° C. for about 0.5 second to about 300 seconds. A higher temperature or lower temperature can be utilized to prolong or shorten the heating time, if it is within the above described temperature range. Particularly, a temperature range of about 110° C. to about 160° C. is useful.

As the heating means, a simple heat plate, iron, heat roller, heat generator utilizing carbon or titanium white, etc., or analogues thereof may be used.

In this invention, a specific method for forming a color image by heat development comprises transfer of a hydrophilic mobile dye. For this purpose, the heat-developable color photographic material of this invention is composed of a support having thereon a light-sensitive layer (I) containing at least silver halide, an organic silver salt oxidizing agent, a dye releasing redox compound which is also a reducing agent for the organic silver salt oxidizing agent and a binder, and a dye fixing layer (II) capable of receiving the hydrophilic diffusible dye formed in the light-sensitive layer (I).

The above described light-sensitive layer (I) and the dye fixing layer (II) may be formed on the same support, or they may be formed on different supports, respectively. The dye fixing layer (II) can be stripped off the light-sensitive layer (I). For example, after the heat-developable color photographic material is exposed imagewise to light, it is developed by heating uniformly and thereafter the dye fixing layer (II) or the light-sensitive layer (I) is peeled apart. Also, when a light-sensitive material having the light-sensitive layer coated on a support and a fixing material having the dye fixing layer (II) coated on a support are separately formed, after the light-sensitive material is exposed imagewise to light and uniformly heated, the mobile dye can be transferred on the dye fixing layer (II) by superposing the fixing material on the light-sensitive material.

Further, there is a method wherein only the light-sensitive layer (I) is exposed imagewise to light and then heated uniformly by superposing the dye fixing layer (II) on the light-sensitive layer (I).

The dye fixing layer (II) can contain, for example, a dye mordant in order to fix the dye. In the this invention, various mordants can be used, and polymer mordants are particularly preferred. In addition to the mordants, the dye fixing layer may contain the bases, base precursors and thermal solvents. In particular, it is particularly preferred to incorporate the bases or base precursors into the dye fixing layer (II) in the cases wherein the light-sensitive layer (I) and the dye fixing layer are formed on different supports.

Polymer mordants used in the present invention are polymers containing secondary and tertiary amino groups, polymers containing nitrogen-containing heterocyclic moieties, polymers having quaternary cation groups thereof, having a molecular weight of from 5,000 to 200,000, and particularly from 10,000 to 50,000.

For example, there are illustrated vinylpyridine polymers and vinylpyridinium cation polymers as disclosed in U.S. Pat. Nos. 2,548,564, 2,484,430, 3,148,061 and 3,756,814, etc., polymer mordants capable of cross-linking with gelatin as disclosed in U.S. Pat. Nos. 3,625,694, 3,859,096 and 4,128,538, British Pat. No. 1,277,453, etc., aqueous sol type mordants as disclosed in U.S. Pat. Nos. 3,958,995, 2,721,852 and 2,798,063, Japanese Patent Application (OPI) Nos. 115228/79, 145529/79 and 126027/79, etc., water-insoluble mordants as disclosed in U.S. Pat. No. 3,898,088, etc., reactive mordants capable of forming covalent bonds with dyes used as disclosed in U.S. Pat. No. 4,168,976 (Japanese Patent Application (OPI) No. 137333/79), etc., and mordants disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78 and 1024/78, etc.

In addition, mordants disclosed in U.S. Pat. Nos. 2,675,316 and 2,882,156 can be used.

Of these mordants, for example, mordants capable of cross-linking with a matrix such as gelatin, water-insoluble mordants, and aqueous sol (or latex dispersion) type mordants are preferably used.

Particularly preferably polymer mordants are described below.

(1) Polymers having quaternary ammonium groups and groups capable of forming covalent bonds with gelatin (for example, aldehydo groups, chloroalkanoyl groups, chloroalkyl groups, vinylsulfonyl groups, pyridiniumpropionyl groups, vinylcarbonyl groups, alkylsulfonoxy groups, etc.), such as

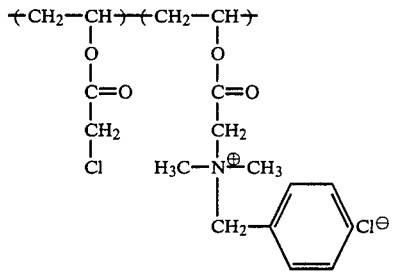

(2) Reaction products between a copolymer comprising a repeating unit of a monomer represented by the general formula described below with a repeating unit of another ethylenically unsaturated monomer and a cross-linking agent (for example, bisalkanesulfonate, bisarenesulfonate, etc.):

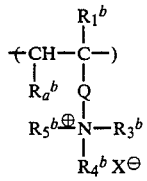

wherein $R_1^b$ represents H or an alkyl group, $R_2^b$ represents H, an alkyl group or an aryl group, Q represents a divalent group, $R_3^b$, $R_4^b$ and $R_5^b$ each represents an alkyl group, an aryl group or at least two of $R_3^b$ to $R_5^b$ are bonded together to form a hetero ring, and X represents an anion. The above described alkyl groups and aryl groups may be substituted.

(3) Polymers represented by the following general formula

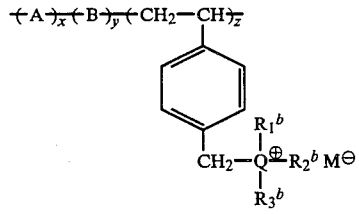

wherein x is from about 0.25 mol% to about 5 mol%, y is from about 0 mol% to about 90 mol%, z is from about 10 mol% to about 99 mol%, A represents a monomer having at least two ethylenically unsaturated bonds, B represents a copolymerizable ethylenically unsaturated monomer, Q represents N or P, $R_1^b$, $R_2^b$ and $R_3^b$ each represents an alkyl group or a cyclic hydrocarbon group or at least two of $R_1^b$ to $R_3^b$ are bonded together to form a ring (these groups and rings may be substituted), and M represents an anion.

(4) Copolymers composed of (a), (b) and (c), wherein (a) is

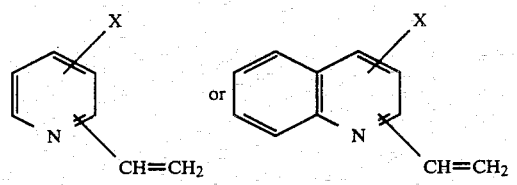

wherein X represents a hydrogen atom, an alkyl group or a halogen atom (the alkyl group may be substituted);

(b) is an acrylic ester; and (c) is acrylonitrile.

(5) Water-insoluble polymers wherein at least ⅓ of the repeating units are those represented by the following general formula

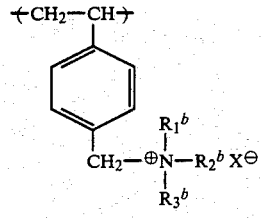

wherein $R_1^b$, $R_2^b$ and $R_3^b$ each represents an alkyl group, with the total number of carbon atoms included being 12 or more (the alkyl group may be substituted), and X represents an anion.

Various kinds of known gelatins can be employed as gelatin for the mordant layer. For example, gelatin which is produced in a different manner such as lime-processed gelatin, acid-processed gelatin, etc., or a gelatin derivative which is prepared by chemically modifying gelatin such as phthalated gelatin, sulfonylated gelatin, etc., can be used. Also, gelatin subjected to a desalting treatment can be used, if desired.

The ratio of polymer mordant to gelatin and the amount of the polymer mordant coated can be easily determined by one skilled in the art depending on the amount of the dye to be mordanted, the type and composition of the polymer mordant and further on the image-forming process used. Preferably, the ratio of mordant to gelatin is from 20/80 to 80/20 (by weight) and the amount of the mordant coated is from 0.5 to 8 $g/m^2$.

The dye fixing layer (II) can have a white reflective layer. For example, a layer of titanium dioxide dispersed in gelatin can be provided on the mordant layer on a transparent support. The layer of titanium dioxide forms a white opaque layer, by which reflection color images of the transferred color images which is observed through the transparent support is obtained.

Typical dye fixing material used in this invention is obtained by mixing the polymer containing ammonium salt groups with gelatin and applying the mixture to a transparent support.

The transfer of dyes from the light-sensitive layer to the dye fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye fixing material, it is not necessary to supply the transfer assistant from the outside. In this case, the above described dye transfer assistant may be incorporated into the material in the form of water of crystallization or microcapsules or as a precursor which releases a solvent at a high temperature.

More preferred process is a process wherein a hydrophilic thermal solvent which is solid at an ambient temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the intermediate layer, the protective layer and the dye fixing layer, it is preferred to incorporate it into the dye fixing layer and/or adjacent layers thereto.

Examples of the hydrophilic thermal solvents includes ureas, pyridines, amides, sulfonamides, imides, alcohols, oximes and other heterocyclic compounds.

The invention will now be described in more detail by the following examples. However, the scope of the invention is not limited to these examples.

EXAMPLE 1

Preparation of silver iodobromide emulsion:

Six kinds of silver halide emulsions each having a different content of silver iodide were prepared by the following methods.

To an aqueous gelatin solution (a solution of 20 g of gelatin and ammonia in 1,000 ml of water maintained at 50° C., the solution is referred to as solution I) were simultaneously added 1,000 ml of an aqueous solution containing potassium iodide and potassium bromide (the solution is referred to as solution II) and an aqueous silver nitrate solution (a solution of 1 mole of silver nitrate in 1,000 ml of water, the solution is referred to as solution III) while maintaining a constant pAg. The form and the size of the emulsion grains thus prepared were adjusted by properly changing the amount of ammonia added and the value of pAg.

By the foregoing procedure, six kinds of silver iodobromide emulsions each having the same regular octahedron form and the same grain size (mean grain size of of about 0.5 μm, mono-dispersed) and having a different content of silver iodide were prepared.

Each of these silver halide emulsions was washed with water, and after removing salts, subjected to a gold sensitization and a sulfur-sensitization using potassium chloroaurate. The amount of each silver halide emulsion was 1.0 kg.

The content of silver iodide of each of the silver halide emulsions is shown below.

| Emulsion | Content of silver iodide |
|---|---|
| A | 0 mole % |
| B | 2.5 mole % |
| C | 5.0 mole % |
| D | 10.0 mole % |
| E | 20.0 mole % |

-continued

| Emulsion | Content of silver iodide |
|---|---|
| F | 40.0 mole % |

The X ray diffraction of each of the foregoing silver halide emulsions was determined but no peak of pure silver iodide was observed.

Preparation of silver benzotriazole emulsion:

In 3,000 ml of water were dissolved 28 g of gealtin and 13.2 g of benzotriazole and the solution was stirred at 40° C. To the solution was added a solution of 17 g of silver nitrate dissolved in 100 ml of water. The pH of the silver benzotriazole emulsion thus obtained was adjusted to flucculate excessive salts, which were removed. Thereafter, the pH was adjusted to 6.0 to provide 400 g of a silver benzotriazole emulsion.

Preparation of gelatin dispersion of dye-providing substance:

To 30 ml of ethyl acetate were added 5 g of magenta dye-providing substance (3), 0.5 g of 2-ethyl succinate-sodium hexylphosphate, and 5 g of tricresyl phosphate and the mixture was heated to about 60° C. to form a homogeneous solution. The solution was mixed with 100 g of an aqueous 10% solution of lime processed gelatin with stirring and then the mixture was treated by a homogenizer at 10,000 r.p.m. for 10 minutes to form the gelatin dispersion of the magenta dye-providing material.

Preparation of light-sensitive coating liquids A to F:

Light-sensitive coating liquids A to F were prepared by mixing, in succession, the following components (a) to (h):

| | |
|---|---|
| (a) Silver benztriazole emulsion | 10 g |
| (b) Each of silver bromide emulsions A to F | 10 g |
| (c) Water | 4 ml |
| (d) Methanol solution of 0.04% sensitizing dye having the following formula | 4 ml |

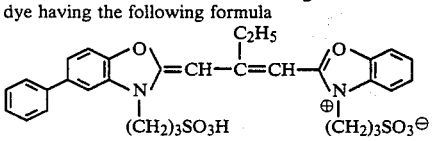

| | |
|---|---|
| (e) Gelatin dispersion of dye-providing substance (3) | 33 g |
| (f) Aqueous solution of 5% surface active agent having the following formula | 5 ml |

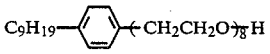

| | |
|---|---|
| (g) Ethanol solution of 10% guanidine-trichloroacetic acid | 12 ml |
| (h) Aqueous solution of 10% dimethylamide | 4 ml |

Preparation of coating liquid for protective layer:

The coating liquid for a protective layer was prepared by mixing, in succession, the following components (a) to (d):

| | |
|---|---|
| (a) Gelatin | 35 g |
| (b) Ethanol solution of 10% guanidine-trichloroacetic acid | 5 ml |
| (c) Aqueous solution of 1% 2-ethyl succinate-sodium hexylsulfonate | 4 ml |
| (d) Water | 56 ml |

Preparation of light-sensitive material:

Each of the foregoing light-sensitive coating liquids A to F was coated on a polyethylene phthalate film having a subbing layer at a silver coverage of 400 mg/m$^2$. In this case a proper aqueous gelating solution was added to each coating liquid so that the dry thickness of each coating liquid became the same. On each coated layer of each of the light-sensitive coating liquids was coated the foregoing coating liquid for a protective layer at a wet thickness of 25 μm followed by drying to provide light-sensitive materials A to F.

Preparation of dye-fixing material:

In 200 ml of water was dissolver 10 g of poly(methyl acrylate-co-N,N,N-trimethyl-N-benzylammonium chloride) (the ratio of methyl acrylate and vinylbenzylammonium chloride was 1:1) and then the solution was uniformly mixed with 100 g of an aqueous 10% solution of lime-processed gelatin. The mixture was uniformly coated on a paper support laminated with polyethylene having dispersed therein titanium dioxide at a wet thickness of 90 μm followed by drying to provide a dye-fixing material having a mordanting layer.

Each of 6 kinds of the color light-sensitive materials thus prepared was exposed through a step wedge to a tungsten lamp of 2,000 lux for 10 seconds. Each of the light-sensitive materials thus exposed was cut into strips and these strips were placed on a heat block heated to 130° C. for 10 sec., 20 sec., 30 sec., and 40 sec., respectively.

Then, after supplying water to the mordanting layer side of the dye-fixing material at 30 ml/m$^2$, each strip of the foregoing light-sensitive materials thus heat-treated was superposed on the dye-fixing material so that the coated layers faced each other. The assembly was heated on a heat block heated to 80° C. for 6 sec., the dye-fixing material was separated from the light-sensitive materials, and the maximum image density of the transferred dye was measured. The results are shown in Table 1.

TABLE 1

| Light-sensitive material (silver iodide content) | Maximum density (per heating time) | | | |
|---|---|---|---|---|
| | 10 sec. | 20 sec. | 30 sec. | 40 sec. |
| A (0 mole %) | 0.31 | 0.54 | 0.78 | 0.85 |
| B (2.5 mole %) | 0.59 | 0.81 | 1.04 | 1.13 |
| C (5 mole %) | 0.87 | 1.06 | 1.26 | 1.29 |
| D (10 mole %) | 1.01 | 1.31 | 1.54 | 1.63 |
| E (20 mole %) | 0.98 | 1.30 | 1.54 | 1.65 |
| F (40 mole %) | 0.90 | 1.20 | 1.38 | 1.59 |

In light-sensitive materials A to F, the content of silver iodide in the silver halide emulsion differed but the layer thickness and other conditions were the same.

Accordingly, from the results shown in Table 1, it is clear that the silver haloiodide having a higher content of silver iodide show improvement of the heat developing speed.

EXAMPLE 2

Multilayer heat developable color photographic materials each having on a support, in succession, the following layers were prepared using 6 kinds of the silver iodobromide emulsions prepared by the same manner as in Example 1.

In addition, sensitizing dye D-1 used for the 3rd layer has the following structure;

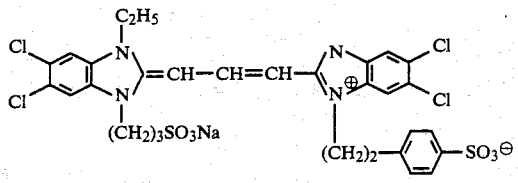

also, sensitizing dye D-2 for the 1st layer has the following structure;

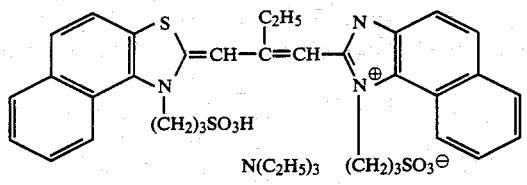

The support: Polyethylene terephthalate film having a subbing layer.

The 1st layer: Red-sensitive silver halide emulsion layer containing the silver iodobromide emulsion (silver haldie emulsion A to F, silver coverage: 300 mg/m$^2$), dimethylsulfamide (coverage: 180 mg/m$^2$), the silver benzotriazole emulsion (silver coverage: 100 mg/m$^2$), sensitizing dye D-2 (coverage: $8\times10^{-7}$ mole/m$^2$), guanidinetrichloroacetic acid (coverage: 440 mg/m$^2$), cyan dye-providing substance (5) (coverage: 300 mg/m$^2$), gelatin (coverage: 1,000 mg/m$^2$), a high boiling solvent, tricresyl phosphate (coverage: 300 mg/m$^2$), and a surface active agent having the following structure (coverage: 100 mg/m$^2$).

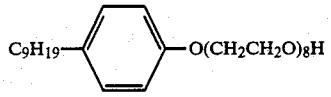

The 2nd layer: Interlayer containing gelatin (coverage: 1,000 mg/m$^2$) and guanidinetrichloroacetic acid (coverage: 190 mg/m$^2$).

The 3rd layer: Green-sensitive silver halide emulsion layer containing the silver iodobromide emulsion (silver halide emulsion A to F, sivler coverage: 300 mg/m$^2$), dimethylsulfamide (coverage: 180 mg/m$^2$), silver benzotriazole emulsion (silver coverage: 100 mg/m$^2$), sensitizing dye D-1 (coverage: $10^{-6}$ mole/m$^2$), guanidinetrichloroacetic acid (coverage: 440 mg/m$^2$), magenta dye-providing substance (3) (coverage: 400 mg/m$^2$), gelatin (coverage: 1,000 mg/m$^2$), tricresyl phosphate (coverage: 400 mg/m$^2$), and the surface active agent as used for the 1st layer (coverage: 100 mg/m$^2$).

The 4th layer: Interlayer containing gelatin (coverage: 1,200 mg/m$^2$) and guanidinetrichloroacetic acid (coverage: 190 mg/m$^2$).

The 5th layer: Blue sensitive silver halide emulsion layer containing the silver iodobromide emulsion (silver haldie emulsion A to F, silver coverage: 300 mg/m$^2$), dimethylsulfamide (coverage: 180 mg/m$^2$), silver benzotriazole emulsion (silver coverage: 100 mg/m$^2$), guanidinetrichloroacetic acid (coverage: 440 mg/m$^2$), yellow dye-providing substance (4) (coverage: 400 mg/m$^2$), gelatin (coverage: 1,000 mg/m$^2$), tricresyl phosphate (coverage: 400 mg/m$^2$), and the surface active agent as used for the 1st layer (coverage: 100 mg/m$^2$).

The 6th layer: Protective layer containing gelatin (coverage: 1,000 mg/m$^2$) and guanidinetrichloroacetic acid (coverage: 190 mg/m$^2$).

Each of the multilayer color light-sensitive materials was exposed through trichromatic separation filters of blue, green, and red having continuously changing density to a tungsten lamp at 2,000 lux for 10 sec. and then was uniformly heated on a heat block heated to 130° C.

Then, water was supplied to the mordanting layer side of the dye-fixing material as used in Example 1 at 30 ml/m$^2$ and each of the foregoing multilayer color light-sensitive materials thus heat-treated was superposed on the dye-fixing material so that the coated layers faced to each other. After heating each assembly on a heat block heated to 80° C. for 6 sec., the dye-fixing material was separated from the light-fixing material, whereby yellow, magenta, and cyan color images each was obtained on the dye-fixing material corresponding to the trichromatic separation filters of blue, green, and red, respectively. The relative sensitivity and the maximum image density of each color image were measured and the results obtained are shown in Table 2.

TABLE 2

| Light-sensitive material | Color image | Relative density* | Maximum density |
|---|---|---|---|
| A' | yellow | 1 | 0.45 |
| (Emulsion A used) | magenta | 0.1 | 0.68 |
| | cyan | 0.9 | 0.54 |
| B' | yellow | 1.5 | 0.77 |
| (Emulsion B used) | magenta | 0.2 | 0.85 |
| | cyan | 1.6 | 0.65 |
| C' | yellow | 1.6 | 1.15 |
| (Emulsion C used) | magenta | 1.6 | 1.51 |
| | cyan | 1.8 | 1.20 |
| D' | yellow | 2.4 | 1.58 |
| (Emulsion D used) | magenta | 2.1 | 2.01 |
| | cyan | 2.7 | 1.85 |
| E' | yellow | 2.5 | 1.78 |
| (Emulsion E used) | magenta | 3.2 | 2.20 |
| | cyan | 3.0 | 2.01 |
| F' | yellow | 2.1 | 1.68 |
| (Emulsion F used) | magenta | 3.0 | 2.22 |
| | cyan | 2.9 | 1.98 |

*The relative sensitivity was a reciprocal of the exposure amount required to give the fog density of +0.3 and was shown by the relative value when the yellow density of the light-sensitive material was defined as 1.

From the results shown in Table 2, it is clear that the color light-sensitive materials using the silver haloiodide of this invention show the high heat developing speed and in the case of using the organic silver salt, the color photographic materials of this invention have high color sensitivity.

While the invention has been described in detail and with reference to specific embodiments thereof, it will be apparent to one skilled in the art that various changes and modifications can be made therein without departing from the spirit and scope thereof.

What is claimed is:

1. A heat developable color photographic material, comprising:

a support having thereon;

a light-sensitive crystal silver haloiodide which does not show a pattern of pure silver iodide in an X-ray diffraction pattern having a silver iodide content of 4 to 40 mole% and which is prepared by simultaneously reacting sources of Ag, I and at least one other halogen while maintaining a constant pAg;

a hydrophilic binder; and a dye-providing substance capable of providing a mobile dye, when the silver haloiodide is reduced to silver upon heating, in chemical relation to the reaction, which has the general formula C-L-D, wherein D is an image-forming dye moiety, L is a bonding group in which the C-L bonding is cleaved at the reaction of an oxidation product of the reduction agent and C is a moiety bonding to an oxidation product of a reducing agent and has a ballast group.

2. A heat developable color photographic material as claimed in claim 1, wherein the light-sensitive mixed crystal silver haloiodide has a silver iodide content of 7 to 30 mole%.

3. A heat developable color photographic material as claimed in claim 1, wherein the light-sensitive mixed crystal silver haloiodide is selected from a group consisting of silver iodobromide and silver chloroiodobromide.

4. A heat developable color photographic material as claimed in claim 1, wherein the light-sensitive mixed crystal silver haliodide is chemically sensitized.

5. A heat developable color photographic material as claimed in claim 1, wherein the light-sensitive mixed crystal silver haloiodide is spectrally sensitized.

6. A heat developable color photographic material as claimed in claim 1, wherein the color photographic material further comprises an organic silver salt oxidizing agent.

7. A heat-developable color photographic material as claimed in claim 6, wherein the organic silver salt oxidizing agent is a silver salt of an organic compound having a carboxy group, a silver salt of a compound containing a mercapto group or a thione group or a silver salt of a compound containing an imino group.

8. A heat developable color photographic material as claimed in claim 6, wherein the total of the silver haloiodide and the silver salt oxidizing agent is in the range of 50 mg/m$^2$ to 10 g/m$^2$ calculated based on the amount of silver.

9. A heat developable color photographic material as claimed in claim 1, wherein the moiety represented by C is selected from a group consisting of an active methylene, an active methine, a phenol residue and a naphthol residue.

10. A heat-developable color photographic material as claimed in claim 1, wherein an amount of the dye providing substance capable of providing a mobile dye is from 10 mg/m$^2$ to 15 g/m$^2$.

11. A heat-developable color photographic material as claimed in claim 1, wherein the color photographic material further contains a reducing agent.

12. A heat-developable color photographic material as claimed in claim 11, wherein an amount of the reducing agent is from 0.01 time to 20 times by mol based on the silver halide.

13. A heat-developable color photographic material as claimed in claim 1, wherein the color photographic material further comprises an auxiliary developing agent.

14. A heat-developable color photographic material as claimed in claim 13, wherein an amount of the auxiliary developing agent is 0.0005 times to 20 times by mol based on silver.

15. A heat-developable color photographic material as claimed in claim 1, wherein the color photographic material further contains a dye releasing activator.

16. A heat-developable color photographic material as claimed in claim 15, wherein the dye releasing activator is a base or a base precursor.

17. A heat-developable color photographic material as claimed in claim 1, wherein the color photographic material further comprises an image receiving layer capable of receiving the hydrophilic dye.

18. A heat-developable color photographic material as claimed in claim 17, wherein the image receiving layer contains a dye mordant.

19. A heat-developable color photographic material as claimed in claim 17, wherein the image receiving layer contains a polymer mordant and gelatin.

20. A heat-developable color photographic material as claimed in claim 1, wherein the color photographic material further contains a transfer solvent.

21. A heat-developable color photographic material as claimed in claim 20, wherein the transfer solvent is water, an alkaline-aqueous solution, an organic solvent having a low boiling point or a mixture thereof.

22. A method of forming a color image, comprising the steps of:

imagewise exposing a heat developable color photographic material, comprising:

a support having thereon;

a light-sensitive crystal silver haloiodide which does not show a pattern of pure silver iodide in an X-ray diffraction pattern having a silver iodide content of 4 to 40 mole% and which is prepared by simultaneously reacting sources of Ag, I and at least one other halogen while maintaining a constant pAg;

a hydrophilic binder; and a dye-providing substance capable of providing a mobile dye, when the silver haloiodide is reduced to silver upon heating, in chemical relation to the reaction, which has the general formula C-L-D, wherein D is an image-forming dye moiety, L is a bonding group in which the C-L bonding is cleaved at the reaction of an oxidation product of the reducing agent and C is a moiety bonding Po an oxidation product of a reducing agent and has a ballast group.

23. A method of forming a color image as claimed in claim 22, wherein the transferring of the hydrophilic diffusible dye is carried out in the presence of a transfer solvent.

24. A method of forming a color image as claimed in claim 23, wherein the transfer solvent is water, an alkaline aqueous solution, an organic solvent having a low boiling point or a mixture thereof.

25. A method of forming a color image as claimed in claim 22, wherein the image receiving material contains a mordant for the hydrophilic diffusible dye.

26. A method of forming a color image as claimed in claim 25, wherein the image receiving material comprises a layer containing a polymer mordant and gelatin.

27. A method of forming a color image as claimed in claim 23, wherein the transfer solvent is present in the image receiving material.

28. A heat-developable color photographic material as claimed in claim 1, wherein said mixed crystal silver haloiodide is prepared by simultaneously adding an aqueous solution of potassium iodide, potassium bromide, and an aqueous silver nitrate solution to an aqueous gelatin solution while maintaining a constant pAg.

29. A heat developable color photographic material, comprising:

a support having thereon;

a light-sensitive crystal silver haloiodide which does not show a pattern of pure silver iodide in an X-ray diffraction pattern having a silver iodide content of 7 to 30 mole% and which is prepared by simultaneously adding an aqueous solution of potassium iodide, potassium bromide, and an aqueous silver nitrate solution to an aqueous gelatin solution while maintaining a constant pAg;

a hydrophilic binder; and a dye-providing substance capable of providing a mobile dye, when the silver haloiodide is reduced to silver upon heating, in chemical relation to the reaction, which has the general formula C-L-D, wherein D is an image-forming dye moiety, L is a bonding group in which the C-L bonding is cleaved at the reaction of an oxidation product of the reducing agent, and C is a moiety bonding to an oxidation product of a reducing agent and has a ballast group which is selected from a group consisting of an active methylene, an active methine, a phenol residue and a naphthol residue.

* * * * *

UNITED STATES PATENT AND TRADEMARK OFFICE

CERTIFICATE OF CORRECTION

PATENT NO. : 4,628,021

DATED : December 9, 1986

INVENTOR(S) : Satoru SAWADA et al.

It is certified that error appears in the above-identified patent and that said Letters Patent is hereby corrected as shown below:

Column 37, line 52, change "dimethylamide" to read

-- dimethylsulfamide --.

Signed and Sealed this

Twenty-second Day of September, 1987

*Attest:*

DONALD J. QUIGG

*Attesting Officer* *Commissioner of Patents and Trademarks*